United States Patent [19]

Luly

[11] Patent Number: 4,821,002

[45] Date of Patent: Apr. 11, 1989

[54] KU BAND POLARIZER

[76] Inventor: Robert A. Luly, 560 W. 40th St., San Bernardino, Calif. 92407

[21] Appl. No.: 178,541

[22] Filed: Apr. 7, 1988

[51] Int. Cl.[4] ..... H01P 1/175

[52] U.S. Cl. ..... 333/21 A; 333/24.3; 343/756

[58] Field of Search ..... 333/21 A, 24.3; 343/756; 29/600

[56] References Cited

U.S. PATENT DOCUMENTS 3,130,379 4/1964 Hadley ..... 333/24.3 X 3,453,563 7/1969 Maurer ..... 333/24.3 X

*Primary Examiner*—Paul Gensler

*Attorney, Agent, or Firm*—Beehler, Pavitt, Siegemund, Jagger, Martella & Dawes

[57] ABSTRACT

Signal degradation is minimized in an electronic polarizer of the type having a circular input waveguide, rectangular output waveguide and an intermediate electromagnetic coil. A ferrite core is contained between impedance matching transformers within a small diameter intermediate waveguide section and air gaps are minimized by ferro-magnetic washers pressed onto the intermediate waveguide to hold the transformers in close contact with the ferrite core ends. The washers also support the electromagnetic coil coaxially within the cylindrical input waveguide, enhance the efficiency of the coil and define the transition walls between the small intermediate waveguide and the larger input and output waveguides.

13 Claims, 1 Drawing Sheet

FIG. 1
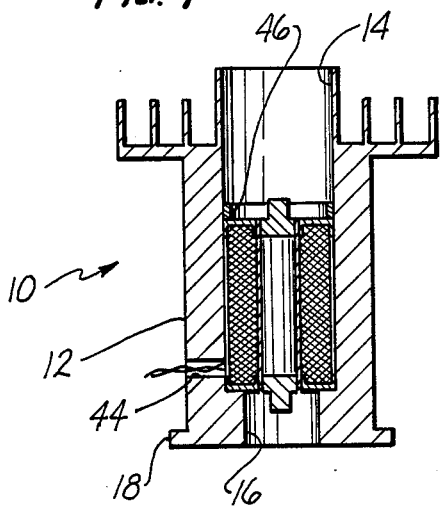
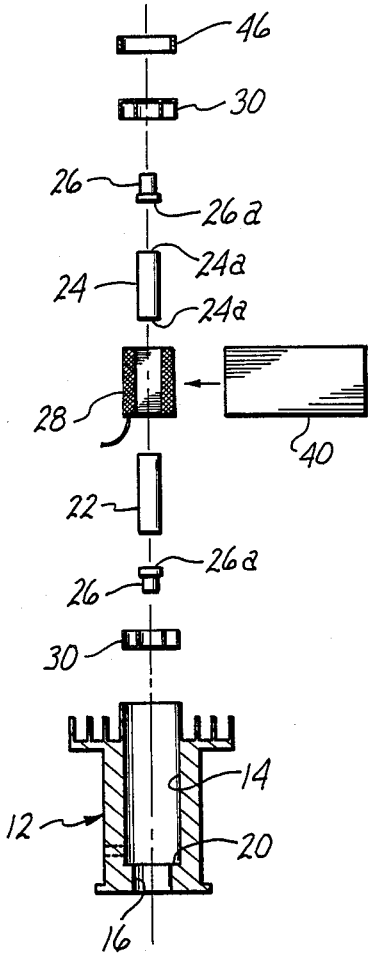
FIG. 2
FIG. 3B
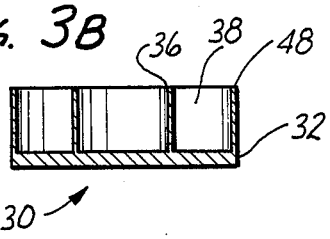
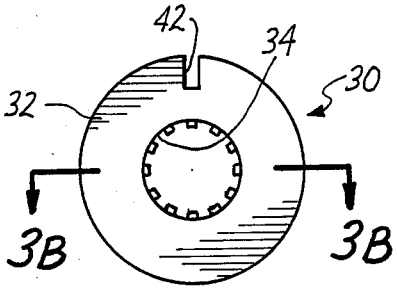
FIG. 3A

KU BAND POLARIZER

BACKGROUND OF THE INVENTION

1. Field of the Invention

The present invention pertains to the field of microwave polarizers of the type used for selecting a desired signal from among multiple signals of diverse polarity, and more particularly is directed to improvements in a polarizer of the electronic type where polarity selection is achieved by rotation of the incoming signals through a magnetic field.

2. State of the Prior Art

A polarizer is a device which, among other applications, finds widespread use in parabolic dish antenna systems for selecting from among multiple signals transmitted on a common frequency but with different polarization, as is common practice in satellite communications. The polarization selection in such systems can be achieved by either mechanical or electronic means. In a typical mechanical system, a low noise amplifier mounted at the antenna focus is rotated so that its rectangular input waveguide is aligned with the desired signal polarization and rejects signals of different polarization. Mechanical systems are however vulnerable to adverse weather conditions such as icing which can immobilize the device, and also tend to be slow in physically rotating the low noise amplifier by means of a small gear motor.

It is well known that the polarization plane of an electromagnetic signal in a waveguide may be rotated by passing the polarized signal through a magnetic field. This characteristic of polarized signals has been exploited in the past to make so-called electronic polarizers which typically consist of a circular input waveguide capable of accepting signals irrespective of polarization, a rectangular output waveguide which admits signals of a particular polarization while rejecting signals of different polarization, and an intermediate waveguide section surrounded by a coil. A magnetic field of adjustable intensity is created within the intermediate waveguide by a variable current applied to the coil. It is conventional to place ferrite or equivalent material within the intermediate waveguide section to thereby enhance the intensity of the polarization controlling magnetic field.

If no current is applied to the coil, a signal applied to the input of the polarizer passes unaffected through the ferrite to the output waveguide. If a current is applied to the coil, the ferrite becomes magnetized and a signal passing through the resultant magnetic field will have its plane of polarization progressively rotated as it advances through the magnetic field. The current to the coil can be adjusted to vary the strength of the magnetic field, thereby adjusting the total angle of rotation between the input and output polarization planes so as to align the output polarization plane of the desired signal with the rectangular output waveguide. The output waveguide will then pass only the desired signal and reject all others.

For optimum results, the intermediate waveguide should be filled with the ferrite material, which in turn requires a reduction in the waveguide cross-section due the considerably higher dielectric constant of the ferrite material compared to atmospheric air. Furthermore, impedances must be matched both at the input air-ferrite and output ferrite-air transitions, which is accomplished with high dielectric constant ceramic transformers. The input and output ceramic transformers and the ferrite slug must fit together with no air gaps between them. Unless these parts fit together within close tolerances, the intervening air gaps cause poor frequency response and signal drop-out at particular frequencies (known as mode spikes).

Presently, Ku band polarizers of the aforedescribed type require components dimensioned to very close tolerances, e.g. 0.0005 inches, and frequently also some way of tuning the device for optimum frequency response. These requirements result in high manufacturing costs which make such devices unattractive for use in consumer market satellite broadcast reception systems.

Electronic polarizers are more reliable than mechanical systems because of the absence of any moving parts and are therefore unaffected by freezing weather and moisture. Further, the polarization switching action of an electronic polarizer is nearly instantaneous for all practical purposes, as compared to the slow mechanical rotation of a motor driven system.

A continuing need therefore exists for lower cost electronic type polarizers which do not significantly degrade weak satellite transmission signals.

SUMMARY OF THE INVENTION

A solution to the high tolerance requirements of current polarizer assembly techniques has been found through the use of ferro-magnetic washers pressed over each end of the smaller diameter ferrite-filled intermediate waveguide. These washers serve to define the transition walls between the smaller intermediate waveguide and the larger input and output waveguides; they improve the magnetic efficiency of the coil so as to minimize the current requirements of the same; and when pressed on the waveguide while the ferrite and ceramic transformers are held together under axial compression, the waveguide ends can be compressed around the ceramic transformers to maintain the parts within the waveguide tube in closely spaced relationship after the axial loading force is removed, eliminating the air gaps which have in the past been responsible for frequency response problems. The ferromagnetic washers support the intermediate waveguide tube in coaxial relationship within the circular input waveguide and the press fit of the washers on the waveguide tube can be made sufficiently tight so that no adhesives are needed to hold any of the parts together, thereby eliminating signal losses introduced by glue previously used in the assembly of such polarizers. An additional benefit obtained by the present invention is the elimination of the 50 ohm film load (about 0.002 inch thick) normally fabricated into the output ceramic transformer and critically aligned across the wide dimension of the output waveguide in order to eliminate mode spikes and cross polarization signals. The film load is not only expensive in itself but introduces a further labor cost because of its critical alignment during assembly into the unit. When the polarizer is properly pressed together using the washers according to this invention, this film load is unnecessary and its elimination substantially reduces the cost of the polarizer.

These and other advantages of the present invention will be better understood from the following detailed description of the preferred embodiment and the attached drawings.

BRIEF DESCRIPTION OF THE DRAWINGS

FIG. 1 is an axial cross-section of an electronic polarizer unit according to this invention;

FIG. 2 is an axially exploded view of the polarizer of FIG. 1;

FIG. 3*a* is a plan view of one of the shoulder washers used in the assembly of FIGS. 1 and 2, seen from the flat side thereof and showing the broaching of the washer center opening.

FIG. 3*b* is a diametric cross-section of the shoulder washer of FIG. 3*a* taken along line A—A of FIG. 3*a;*

DETAILED DESCRIPTION OF THE PREFERRED EMBODIMENT

With reference to the drawings, FIG. 1 shows the assembled polarizer unit 10 which includes a polarizer body 12 defining a cylindrical input waveguide 14 and a rectangular output waveguide 16 with a wide dimension and a narrow transverse dimension, terminating in rear mounting flange 18 provided for bolting the unit to a similar flange on a low noise amplifier or other system component.

The cylindrical input waveguide 14 and rectangular output waveguide 16 are axially aligned and meet at a transition shoulder 20 best seen in the exploded view of FIG. 2. A cylindrical slug 24 of lithium ferrite makes a close sliding fit within an intermediate waveguide tube 22. The ferrite slug is somewhat shorter than the waveguide tube so as to admit the wider inner portion of a ceramic impedance matching transformer 26 at each end of the waveguide tube 22. The transformers 26 each have an inner flat surface 26*a* which abuts against a corresponding end surface 24*a* of the ferrite slug 24 when assembled into the waveguide tube 22. Electromagnetic coil 28 is then slipped axially over the waveguide tube 22 and secured in place by two soft iron shoulder washers 30 press fitted onto each of the two opposite ends of the waveguide tube 22 with the coil 28 in between. The construction of the shoulder washers 30 is better appreciated by reference to FIGS. 3*a* and 3*b*. The two shoulder washers may be identical, each having a washer disc 32 with a central aperture 34. On one face of the washer disc 32 are two circumferential shoulders oriented axially to the disc: a radially outer shoulder 48 at the outer edge of the washer disc 32 and a radially inner shoulder 36 at the inner edge of the washer aperture 34 such that the inner shoulder defines a short cylindrical bore within the washer. Between the two shoulders 48, 36 is an annular space 38 into which fits one end of the coil 28. The inner surface of the washer bore i.e., the inner surface of the inner shoulder 36 is broached or grooved longitudinally at 12 circumferentially spaced locations so as to provide relief channels into which metal can displace when each shoulder washer 30 is tightly pressed onto a corresponding end of an aluminum waveguide tube 22. For a Ku Band polarizer, FIGS. 3*a* and 3*b* give preferred shoulder washer dimensions. For the washer dimensions given the aluminum intermediate waveguide tube 22 has an inside diameter of 0.283 inches and a tube wall thickness of 0.014 inches. The tight press fit of the washers has a crimping effect on the ends of the waveguide tube 22 causing the waveguide tube wall to tightly grip the ceramic transformers 26.

The transformers 26 are axially compressed against the ends of the ferrite slug 24 by any suitable means not shown here and are maintained in this axially preloaded state during the press fitting of the shoulder washers 30 onto the two ends of waveguide tube 22. The deformation of the waveguide tube ends resulting from the tight fit securely grips the two ceramic transformers and holds the same against separation from the ferrite slug 24 even after the axial compressive loading force is removed, thereby retaining the ferrite and ceramic components in closely adjacent contact without substantial air gaps between the transformer end surfaces 26*a* and corresponding ferrite end surfaces 24*a*.

The diameter of the two shoulder washers 30 desirably make a close sliding fit with the inside diameter of the circular waveguide 14 so that the entire washer/coil/waveguide 22 assembly slides axially into the cylindrical input waveguide through the open forward end of the polarizer body 12 until the inner washer 30 abuts against the transition shoulder in the polarizer body. The washers therefore serve to maintain the smaller, intermediate waveguide 22 in coaxial relationship within the circular waveguide 14 and also serve to define the end surfaces or transition walls between the intermediate waveguide 22 and both the input and output waveguides, in addition to holding the ceramics/ferrite components in gapless axially adjacent disposition.

The wire coil 28 is wrapped in a sheet of magnetic shielding material 40 which extends axially between the two shoulder washers 30 and together with the washers provides a magnetic flux return path for the coil 28 thereby increasing the magnetic efficiency of the coil for a given current input. The connecting wires of coil 28 are lead out through a radial wire slot 42 in the lower shoulder washer 30 and fed through an exit hole 44 in the polarizer body 12 for connection to a suitable current source. The entire coil/intermediate waveguide assembly is secured against the transition shoulder 20 of the polarizer body by a press fitted retaining ring 46 which holds the coil/waveguide 22 assembly from sliding away from the transition shoulder.

The shoulder washers 30 are preferably made of soft iron which is capable of flowing somewhat and thus make a good circumferential mechanical grip on the ends of the waveguide tube 22.

While a preferred embodiment of the invention has been described and illustrated for purposes of clarity and example, it must be understood that various changes, substitutions and modifications to the described embodiment will be readily apparent to those possessed or ordinary skill in the art without departing thereby from the scope and spirit of the present invention which is defined only by the following claims.

What is claimed is:

1. An electronic polarizer comprising:

a polarizer body defining a circular input waveguide and a rectangular output waveguide connected by a wavepath containing a magnetizable medium substantially transparent to microwave radiation interposed between impedance matching means;

a magnetic coil about said magnetizable medium for variably magnetizing said medium by means of an adjustable electric current through said coil; and ferro-magnetic cap means at each end of said coil for holding said impedance matching means and said magnetizable medium in axially compressed relationship thereby to substantially eliminate air gaps therebetween.

2. An electronic polarizer comprising:

a polarizer body defining a circular input waveguide and a rectangular output waveguide connected by a waveguide tube of smaller aperture containing a magnetizable medium substantially transparent to microwave radiation;

said medium interposed between impedance matching means contained in said tube;

a magnetic coil about said tube for variably magnetizing said medium by means of an adjustable electric current through said coil thereby to rotate the plane of polarization of an electromagnetic wave passing through said tube; and ferro-magnetic cap means pressed onto each end of said tube for holding said impedance matching means and said magnetizable medium in axially compressed relationship thereby to substantially eliminate air gaps therebetween.

3. The polarizer of claim 2 wherein said magnetizable medium is a ceramic/ferrite.

4. The polarizer of claim 3 wherein said impedance matching means are ceramic transformers.

5. The polarizer of claim 4 wherein said ferro-magnetic cap means are soft-iron shoulder washers.

6. An electronic polarizer comprising:

a polarizer body defining a circular input waveguide and a rectangular output waveguide connected by a waveguide tube of smaller aperture containing a ceramic/ferrite slug;

a ceramic impedance matching transformer contained at each end of said tube;

a magnetic coil about said tube for variably magnetizing said slug by means of an adjustable electric current through said coil thereby to rotate the plane of polarization of an electromagnetic wave passing through said tube; and shoulder washers of soft ferro-magnetic material means pressed onto each end of said tube for holding said impedance matching transformers in close substantially gapless contact with said ceramic/ferrite slug.

7. The polarizer of claim 6 further comprising a transition shoulder defined in said body between said cylindrical and rectangular waveguides, and a retaining ring pressed into said cylindrical waveguide and against one of said shoulder washers thereby to hold the opposite of said shoulder washers against said transition shoulder, whereby said polarizer may be held together without adhesives.

8. The polarizer of claim 6 further comprising magnetic shielding means between said shoulder caps and providing therewith a magnetic flux return path for said coil.

9. An electronic polarizer comprising:

a polarizer body defining a circular input waveguide and a rectangular output waveguide connected by a waveguide tube of smaller aperture containing a cylindrical ceramic/ferrite slug;

a ceramic impedance matching transformer contained at each end of said tube;

a magnetic coil about said tube for variably magnetizing said slug by means of an adjustable electric current through said coil thereby to rotate the plane of polarization of an electromagnetic wave passing through said tube; and circular washers of soft ferro-magnetic material means pressed onto each end of said tube and slightly deforming said tube for holding said impedance matching transformers in close substantially gapless contact with each end of said ceramic/ferrite slug;

magnetic shielding means between said washers and providing therewith a magnetic flux return path for said coil;

a transition shoulder defined in said body between said cylindrical and rectangular waveguides, and a retaining ring pressed into said cylindrical waveguide and against one of said shoulder washers thereby to hold the opposite of said washers against said transition shoulder, said washers supporting said waveguide tube coaxially within said circular waveguide whereby said polarizer may be held together without adhesives.

10. A method for making an electronic polarity rotator of the type having a polarizer body defining a circular input waveguide and a rectangular output waveguide connected by a wavepath containing a magnetizable medium substantially transparent to microwave radiation interposed between impedance transformer means, and a magnetic coil about said magnetizable medium for variably magnetizing said medium by means of an adjustable electric current through said coil, comprising the steps of:

providing a waveguide tube of smaller diameter than said circular waveguide;

placing said magnetizable medium within said waveguide tube;

placing said transformer means into each end of said tube;

placing said magnetic coil coaxially on said tube;

applying axially compressive force urging said transformer means against said magnetizable medium to substantially eliminate air gaps therebetween;

press-fitting a washer of ferromagnetic material onto each end of said tube during said axial compression so as to deform the tube ends and thus maintain said transformer means in substantially gapless adjacent relationship with said magnetizable medium thereby to avoid air-gaps between said transformer means after removal of said compressive force;

removing said axially compressive force; and fitting the magnetic coil and waveguide tube assembly into the polarizer body with the waveguide tube communicating the rectangular and circular waveguides.

11. The method of claim 10 further comprising the step of providing a cylindrical magnetic shield about said magnetic coil between said washers, whereby said washers and shield together provide a magnetic flux return path for improving the magnetic efficiency of said coil.

12. The method of claim 10 wherein said magnetizable medium is a cylindrical slug of ceramic/ferrite having flat end surfaces and said transformer means are cylindrical elements having a flat end surface abutting against each end surface of said slug.

13. The method of claim 10 further comprising the step of press fitting a retainer ring into said circular input waveform and against one said shoulder washer thereby to retain the other shoulder washer against said transition shoulder.

* * * * *